United States Patent [19]

Kochmanski et al.

[11] Patent Number: 4,744,567

[45] Date of Patent: May 17, 1988

[54] DUCK ON THE ROCK

[76] Inventors: Voldemore F. Kochmanski, 876 S. Brookside Dr., Muskegon, Mich. 49441; George Spector, 233 Broadway, Rm. 3815, New York, N.Y. 10007

[21] Appl. No.: 918,786

[22] Filed: Oct. 14, 1986

[51] Int. Cl.[4] ..... A63B 71/04

[52] U.S. Cl. ..... 273/393; 273/1

[58] Field of Search ..... 273/393, 19 F

[56] References Cited

U.S. PATENT DOCUMENTS

| | | | |
|---|---|---|---|
| 2,430,681 | 11/1947 | Johnson | 273/393 |
| 2,520,392 | 8/1950 | Flenghi | 273/393 |
| 3,761,087 | 9/1973 | Meyer | 273/393 |
| 4,135,715 | 1/1979 | Soulos | 273/1 GF |
| 4,303,240 | 12/1981 | Ellman et al. | 273/1 GF |

OTHER PUBLICATIONS

Hindman, Darwin A.; Kick the Can and Over 800 Other Active Games and Sports for all Ages; 6-1984; pp. 76-77; Duck-on-the-Rock.

*Primary Examiner*—Paul E. Shapiro

[57] ABSTRACT

A duck on a rock game is provided and consists of a plurality of playing pieces and a base member whereby one of the playing pieces is positioned on the base member and during play of the game another of the playing pieces can be placed upon the first playing piece. Each playing piece has a flat top surface of given area. A disc, with a flat top of lesser area, is screw threaded to each playing for adjustment between a raised and flush position relative to the flat top of the playing piece to change the area for supporting a superimposed playing piece.

2 Claims, 1 Drawing Sheet

DUCK ON THE ROCK

BACKGROUND OF THE INVENTION

The instant invention relates generally to games and more specifically it relates to a duck on a rock game.

Numerous games have been provided in prior art that are adapted to be played by a group of players who strike at playing pieces in the course of the game. For example, U.S. Pat. Nos. 269,351; 1,777,249 and 3,747,929 all are illustrative of such prior art. While these units may be suitable for the particular purpose to which they address, they would not be as suitable for the purposes of the present invention as heretofore described.

SUMMARY OF THE INVENTION

A primary object of the present invention is to provide a duck on a rock game that will overcome the shortcomings of the prior art devices.

Another object is to provide a duck on a rock game in which each player tries to knock the duck off the rock and get back to a boundary line without getting tagged by one of the players that's it.

An additional object is to provide a duck on a rock game that includes an adjustable top on the ducks to make piggybacking of the ducks more difficult during the play of the game.

A further object is to provide a duck on a rock game that is simple and easy to play.

A still further object is to provide a duck on a rock game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
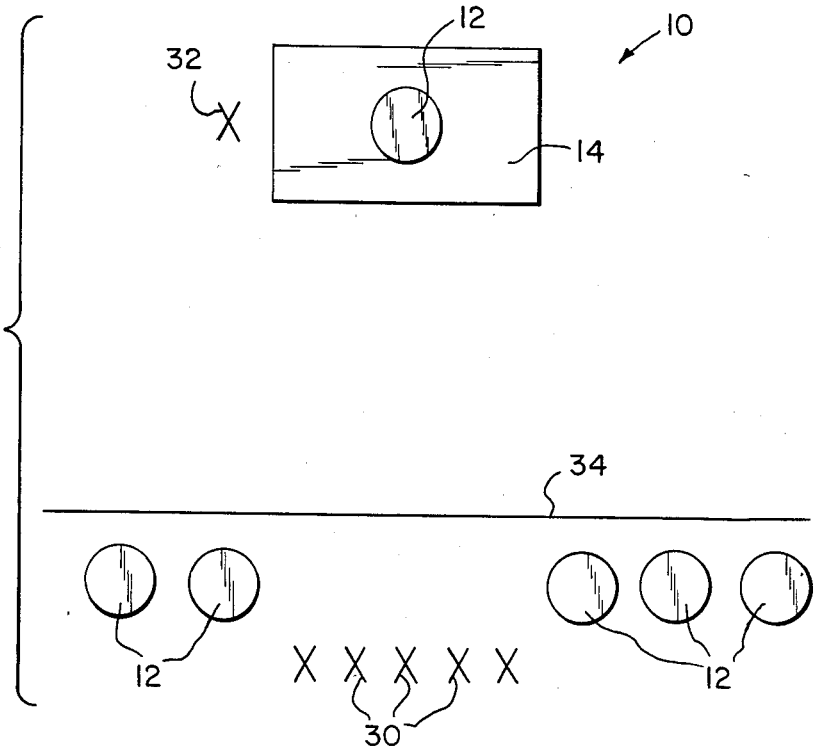
FIG. 1 is a diagrammatic top plan view of the invention.
Figure 2:
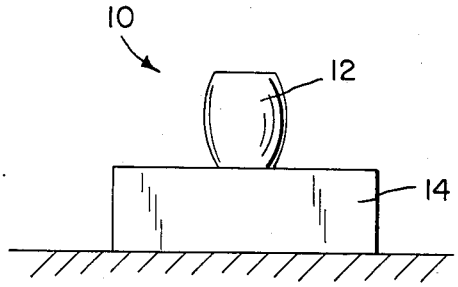
FIG. 2 is a front elevational view of the rock with an "it" duck thereupon.

Turning now descriptively to the drawings, in which similar reference characters denote similar elements throughout the several views, FIGS. 1 and 2 illustrate a duck on a rock game 10 that consists of a plurality of playing pieces 12 and a base member 14. One of the playing pieces 12 is positioned on the base member 14. During play of the game 10 another of the playing pieces 12 can be placed upon the first playing pieces. Each of the playing pieces 12 is shaped like a barrel and called a duck. The base member 14 is shaped like a rectangular box and called a rock. The playing pieces 12 and the base member 14 are all molded out of plastic material.

Figure 4:
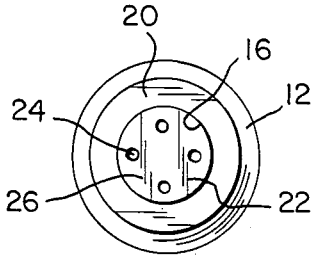
FIG. 4 is a top view as indicated by arrow 4 in FIG. 3 showing finger grip holes in the adjustable top.
Figure 3:
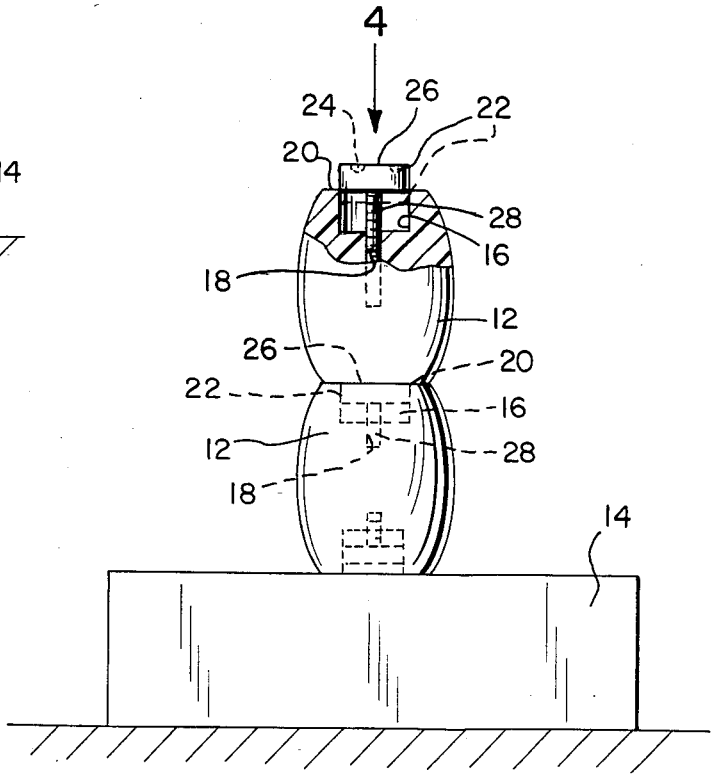
FIG. 3 is an enlarged elevational view with parts broken away of a modification in which each of the ducks include an adjustable top to make piggybacking of ducks more difficult.

A modification is shown in FIGS. 3 and 4 in which each of the playing pieces 12 have a cylindrical recess 16 with a central threaded bore 18 at one end 20. A cylindrical member 22 is provided and has a plurality of finger grip holes 24 on top 26. A central threaded shaft 28 extends downwardly from the cylindrical member 22. The shaft 28 can threadably engage the bore 18 allowing the cylindrical member 22 to be adjustable within the cylindrical recess 16 making it more difficult when another of the playing pieces 12 is placed thereupon.

The game 10 may be played by any desired number of players 30. The player 32 that is "it" sets his playing piece 12 on the base member 14 for the other players 30 to knock off. All players 30, except the one that is "it", go behind a boundary line 34. They try to knock the playing pieces 12 off the base member 14 before the player 32 that is "it" can tag one of them while they try to get their own playing piece 12 and get back to the boundary line 34. The player 32 that is "it" must make sure that his playing piece 12 is on the base member 14 before he can tag a player 30. Also he must take his playing piece 12 after tagging a player 30 and make it to the boundary line 34 before the tagged player 30 sets his playing piece 12 on top of the other playing piece. If the tagged player 30 does not set his playing piece 12 on top before the "it" player 32 gets his playing piece out of the way then they are both it.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A duck on a rock game comprising:

(a) a plurality of playing pieces; and (b) a base member whereby one of said playing pieces is positioned on said bae member and during play of said game another of said playing pieces can be placed upon said first playing piece further comprising:

(c) each of said playing pieces is shaped like a barrel and called a duck;

(d) said base member is shaped like a rectangular box called a rock; further comprising:

(e) each of said playing pieces having a cylindrical recess with a central threaded bore at one end; and (f) a cylindrical member having a plurality of finger grip holes on top with a central threaded shaft extending downwardly therefrom so that said shaft can threadably engage said bore allowing said cylindrical member to be adjustable with said cylindrical recess making it more difficult when another of said playing pieces is placed thereupon.

2. A duck on the rock game comprising the following equipment:

(a) a plurality of playing pieces each with a flat top surface of given area;

(b) a base for stacking playing pieces successively thereupon;

(c) adjustable means for increasing the difficulty of stacking playing pieces on top of each other, wherein said means comprise a disc with a flat top of lesser area adjustably mounted on each said piece whereby said disc flat top is adjustable to a raised position above said flat top surface of the playing piece thus reducing the area of support for a superimposed playieng piece.

* * * * *